United States Patent [19]

Bauer et al.

[11] Patent Number: 4,677,256

[45] Date of Patent: Jun. 30, 1987

[54] FLEXIBLE ELECTRICAL CONTROL CABLE

[75] Inventors: Albert Bauer; Arnd-Gunther Carl, both of Neustadt; Klaus Lotter, Grossenseebach, all of Fed. Rep. of Germany

[73] Assignee: Siemens Aktiengesellschaft, Munich, Fed. Rep. of Germany

[21] Appl. No.: 766,930

[22] Filed: Aug. 19, 1985

[30] Foreign Application Priority Data

Aug. 31, 1984 [DE] Fed. Rep. of Germany ..... 3432600

[51] Int. Cl.[4] ..... H01B 7/04

[52] U.S. Cl. ..... 174/116; 174/115; 174/113 R; 174/113 C; 174/131 R; 174/131 A

[58] Field of Search ..... 174/115, 116, 113 R, 174/113 C, 131 R, 131 A

[56] References Cited

U.S. PATENT DOCUMENTS

| | | | |
|---|---|---|---|
| 2,048,450 | 7/1936 | Horn | 174/113 R |
| 2,953,627 | 9/1960 | Malneritch et al. | 174/113 R |
| 3,099,703 | 7/1963 | Martin | 174/113 R |
| 3,857,996 | 12/1974 | Hansen et al. | 174/113 R |
| 3,993,860 | 11/1976 | Snow et al. | 174/115 X |
| 4,084,065 | 4/1978 | Swenson | 174/113 R X |
| 4,110,554 | 8/1978 | Moore et al. | 174/115 X |
| 4,570,477 | 2/1986 | Sugibuchi | 174/115 X |

FOREIGN PATENT DOCUMENTS 3139018 4/1983 Fed. Rep. of Germany .

OTHER PUBLICATIONS

Elekmschlenfahige Kunsistoffe 72 (1982)8 "Gebirgstelefon-Luftkabel mit Aramid-Fasern", p. 486.

Kabel und Leitungen "Neue Aufzugsteuerleitungen fu hohen Beanspruchungen" Arnd-Gunther Carl, Klaus Lotter, pp. 26, 27.

*Primary Examiner*—Morris H. Nimmo

*Attorney, Agent, or Firm*—Kenyon & Kenyon

[57] ABSTRACT

So as to eliminate wind dependent displacements in control cables such as are used in container loading facilities, the weight of the cable itself is increased. To this end, braided-over lead cords are arranged in the central elements of each conductor bundle and in the corner spaces of the core. The load-carrying capacity of the carrier member is ensured by high tensile strength plastic filaments in the form of a braid and optionally in the form of corner fillings.

2 Claims, 1 Drawing Figure

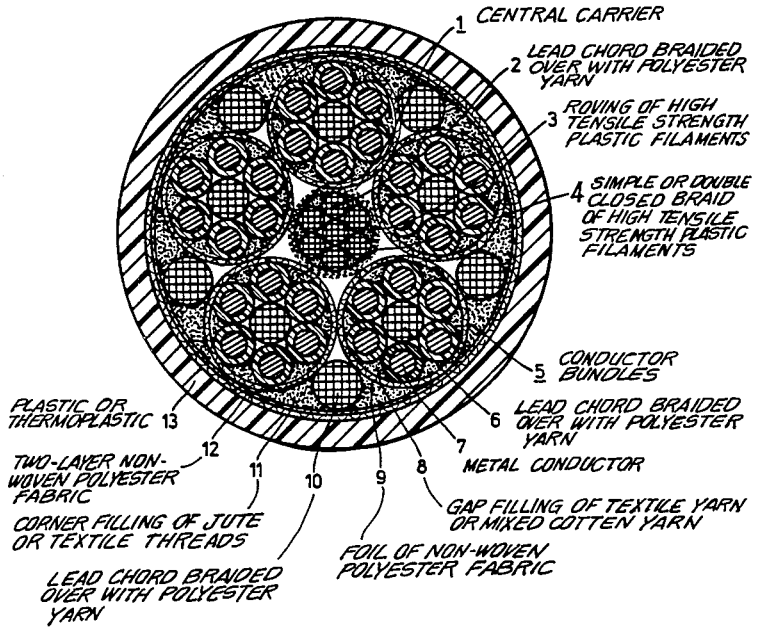

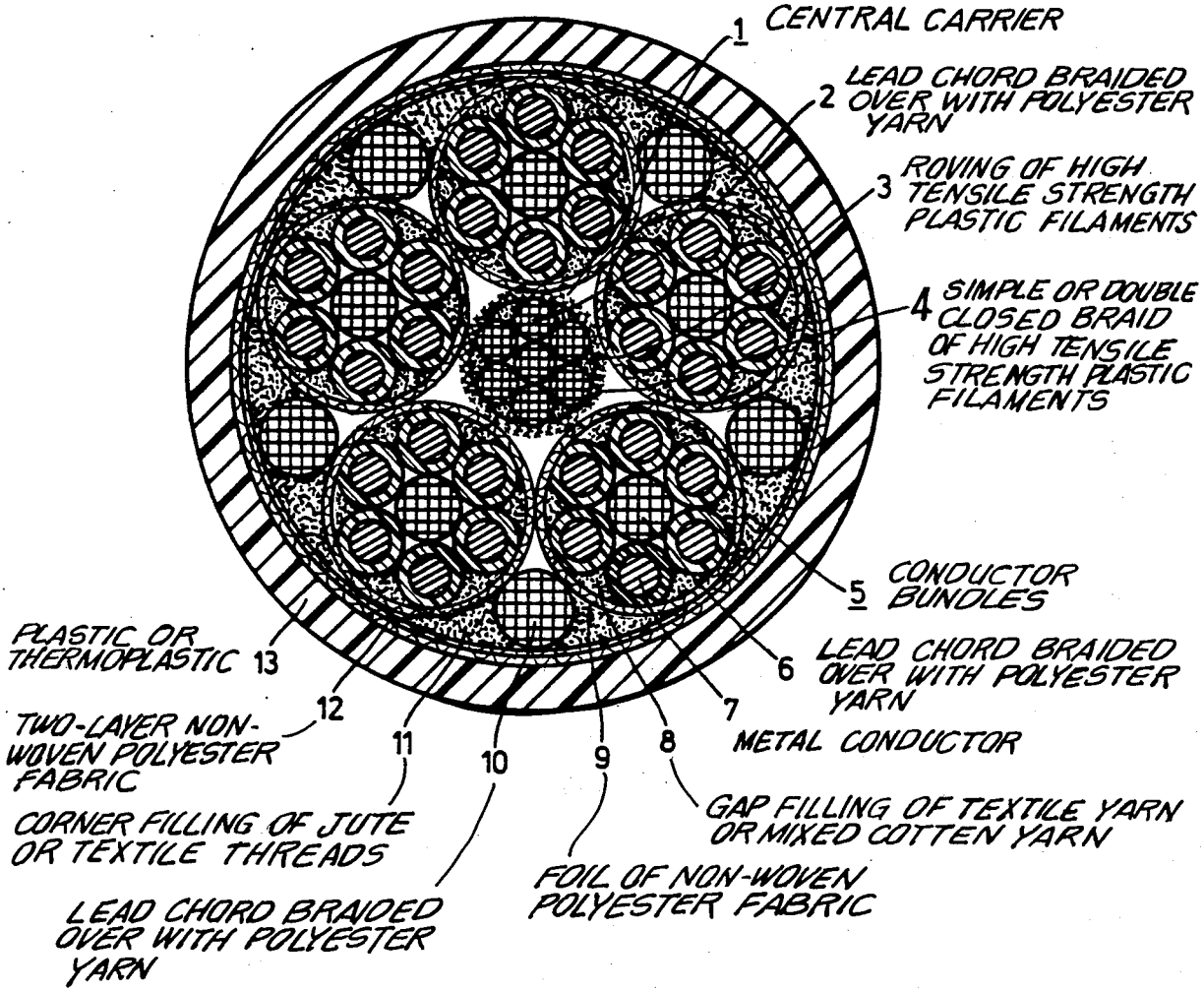
1 CENTRAL CARRIER
2 LEAD CHORD BRAIDED OVER WITH POLYESTER YARN
3 ROVING OF HIGH TENSILE STRENGTH PLASTIC FILAMENTS
4 SIMPLE OR DOUBLE CLOSED BRAID OF HIGH TENSILE STRENGTH PLASTIC FILAMENTS
5 CONDUCTOR BUNDLES
6 LEAD CHORD BRAIDED OVER WITH POLYESTER YARN
7 METAL CONDUCTOR
8 GAP FILLING OF TEXTILE YARN OR MIXED COTTEN YARN
9 FOIL OF NON-WOVEN POLYESTER FABRIC
10 LEAD CHORD BRAIDED OVER WITH POLYESTER YARN
11 CORNER FILLING OF JUTE OR TEXTILE THREADS
12 TWO-LAYER NON-WOVEN POLYESTER FABRIC
13 PLASTIC OR THERMOPLASTIC

FLEXIBLE ELECTRICAL CONTROL CABLE

BACKGROUND OF THE INVENTION

This invention relates to flexible electrical cables in general and in particular to the mechanical design of a type of control cable which is employed in container loading devices, known as a spreader cable.

For the operation of machinery, transport and conveyor installations, flexible electrical cables have been developed in which, in a control cable design, the conductors are twisted in layers to form the core of the control cable over which suitable layers are provided. In the center of the cable, a carrier member in the form of a steel cable or a cable of non-metallic materials which does not exhibit much stretch when placed in tension can be arranged (VDE Specification 250 c/8.75, para. 814). Non-metallic materials which can be used for this purpose include for instance, fibers with an aramide base (German Journal "Kunststoffe", 1982, Page 486). Such a flexible cable can be used in a container loading facility (German Journal "Siemens Energietechnik", 1983, Pages 188 to 191) in such a manner that when the lifting device is moved, the cable is continuously deposited in a funnel when moving in one direction and taken up again when moving in the other. In this process the cable is freely conducted vertically through the air over a fairly great height. Under unfavorable weather conditions, especially in a wind storm, the cable can be heavily bent, which impedes the motion cycle of the cable.

For elevator control cables, a cable design is known in the art in which five conductors are always twisted around a high tensile strength central member to form a bundle and in which six of such conductor bundles are twisted around a carrier member. The core so formed and equipped with textile inserts is surrounded by wrapping and a plastic jacket. This cable design is distinguished by great flexibility, high bending strength and absolute stability of the conducting assembly (German Journal "Elektrodienst",. 1983, No. 1, Pages 26/27). For adapting an elevator control cable to the technical development in the field of electronic control and to the use of microprocessors, a cable design is also known in which the conductors have a small cross section and are twisted in one layer about a central element which consists of a load cord. With this heavy central element of large weight, the influence of the insulating and jacket materials on the running and suspension behavior of the cable is reduced (DE-OS No. 31 39 018).

Starting with a cable with the features described above in German Journal "Elektrodienst", it is an object of the present invention to improve the physical conductability of the cable in such a manner that the cable construction is better able to withstand wind forces and to thereby make possible the use of this cable as a "spreader cable".

SUMMARY OF THE INVENTION

To solve this problem, according to the present invention, the central carrier member comprises an assembly of braided lead cords to which a braid of high tensile strength plastic filaments is applied; the central element of each conductor bundle surrounding the central carrier member comprises a lead cord which is braided over; and lead cords which have been braided over are also arranged in the outer corners of the core structure in the spaces between conductor bundles.

The design of the cable provided in accordance with the present invention causes an increase of its own weight without increasing its flow resistance in the transversal direction or a reduction of its flexibility. Thereby, however, the extent of the lateral excursion of the freely suspended cable under the influence of wind is reduced. The high tensile strength plastic filaments which are arranged in the carrier member and which are preferably rovings with an aramide base, contribute to the preservation of the flexibility of the cable as well as to the preservation of the required tensile strength. The corner spaces of the carrier member can also be filled with such high tensile strength plastic filaments.

BRIEF DESCRIPTION OF THE DRAWINGS

The single FIGURE is a cross-sectional view of the cable according to the present invention.

DETAILED DESCRIPTION

The FIGURE shows a control cable having five bundles, twisted about a central carrier member 1. Carrier member 1 comprises of seven lead cores 2, each of which has braided thereover polyester yarn, six lead cords being arranged around a central lead cord. These lead cords can be arranged parallel or twisted with each other. In the outer corner spaces of the assembly formed by the lead cords 2, rovings 3 of high tensile strength plastic filaments, for instance, with a base of aramid are arranged. Lead cords 2 and corner fillings 3 are surrounded by a holding helix, not specifically designated, which can also consist of high tensile strength plastic filaments. Thereon, a simple or double closed braid 4 of high tensile strength plastic filaments, especially of aramide rovings, is arranged.

Around the carrier member 1, five conductor bundles 5 are twisted, each of which consists of a central element 6 and six plastic insulated conductors 7. The central elements 6 are likewise lead cords which have been braided over. The corner spaces of each conductor bundle are filled with gap fillings 8 of a textile yarn or a mixed cotton yarn. Each conductor bundle is wrapped with a foil 9 of non-woven polyester fabric.

Further braided-over lead cords 10 are arranged in the corner spaces of the core made up of the carrier member 1 and the conductor bundles 5. The remaining portions of the corner spaces are filled in a well known manner with a corner filling 11 of jute or textile threads. The conductor core as a whole is surrounded by a two-layer wrapping 12 of non-woven polyester fabric and a plastic jacket 13. Since the new cable cannot be wound on a drum, the conductor insulation and the jacket may consist of thermoplastic material; the conductor insulation may consist, for instance, of polyvinylchloride and the jacket, for instance, of polyurethane.

What is claimed is:

1. In a flexible electrical control cable comprising a plurality of conductor bundles twisted on a carrier member, each conductor bundle comprising a central element with conductors twisted thereon, and a wrapping and a plastic jacket surrounding the core formed by the carrier member and the conductor bundles, the improvement comprising:

(a) the carrier member comprising a plurality of lead cords in longitudinal abutting relationship, each having a braid applied thereover with a further braid of high tensile strength plastic filaments applied over said plurality of cords;

(b) the central element of each conductor bundle comprising a braided-over lead cord; and (c) braided-over lead cords disposed in the outer corner spaces of the core between the conductor bundles and the wrapping.

2. A control cable according to claim 1, and further including high tensile strength plastic filaments disposed in the corner spaces of the carrier member.

* * * * *